US006419591B1

(12) United States Patent
Addeo et al.

(10) Patent No.: US 6,419,591 B1
(45) Date of Patent: Jul. 16, 2002

(54) SWING WEIGHT APPARATUS FOR ATTACHMENT TO A GOLF CLUB HEAD

(76) Inventors: Eric M. Addeo, 3410 N. Bartlett Ave., Milwaukee, WI (US) 53211; Liane Kobs Hamilton, 1028 E. Juneau, #510, Milwaukee, WI (US) 53202

( * ) Notice: Subject to any disclaimer, the term of this patent is extended or adjusted under 35 U.S.C. 154(b) by 0 days.

(21) Appl. No.: 09/658,433

(22) Filed: Sep. 8, 2000

(51) Int. Cl.[7] ..... A63B 69/36
(52) U.S. Cl. ..... 473/256; 150/160; 273/DIG. 30
(58) Field of Search ..... 473/437, 256, 473/231, 238; 150/160; 206/315.4; 273/DIG. 30

(56) References Cited

U.S. PATENT DOCUMENTS 2,737,394 A * 3/1956 Abel
3,145,749 A * 8/1964 Rosenow
3,593,769 A * 7/1971 Spears
4,045,034 A * 8/1977 Thomas
4,052,061 A * 10/1977 Stewart
4,842,280 A * 6/1989 Hilton
5,294,127 A * 3/1994 Keelan
5,403,009 A * 4/1995 Gleason
6,102,810 A * 8/2000 Boland

FOREIGN PATENT DOCUMENTS

WO 8501219 * 3/1985

* cited by examiner

*Primary Examiner*—Sebastiano Passaniti
(74) *Attorney, Agent, or Firm*—Donald J. Ersler

(57) ABSTRACT

A swing weight apparatus includes a swing weight body and at least one insertable weight. A swing weight body includes a bottom layer, a middle layer, and a top layer. Each layer preferably has a perimeter which has a substantially curved portion and a substantially straight portion. The substantially curved portion of each layer are attached to each other. The bottom layer and the top layer are releasably joined to each other on the substantially straight portion with a removable fastener such as a zipper or a hook and loop fastener. Each insertable weight preferably includes a quantity of weighted material which is retained between two outside layers. The perimeter of each insertable weight is shaped to fit between the middle and top layers. The perimeters of the two weighted layers are attached to each other with the weighted material therein. Preferably, a hosel strap is attached to one end of the substantially straight portion. The hosel strap has a releasable fastener which allows thereof to be attached to itself.

17 Claims, 3 Drawing Sheets

SWING WEIGHT APPARATUS FOR ATTACHMENT TO A GOLF CLUB HEAD

BACKGROUND OF THE INVENTION

1. Field of the Invention

The present invention relates generally to devices for practicing the swing of a golf club and more specifically to a swing weight apparatus for attachment to a golf head.

2. Discussion of the Prior Art

Currently, there appears to be only one device which may be attached to a golf club for training purposes. A weighted donut shaped device is placed over the handle and slid down the club shaft until it is adjacent the golf club head. The extra weight increases the weight during practice swings so that the golfer will be able to hit the ball harder without the weighted donut device. The disadvantage of the weighted donut device is that the weight thereof cannot be changed without adding or removing extra weighted donuts to increase or decrease the weight. Further, a slow swing of the golf club may result in weighted donut device falling down the club shaft. Lastly, the weighted donut device only rests near the top of the golf club head and does not become a unitary portion of the head.

Accordingly, there is a clearly felt need in the art for a swing weight apparatus which may be securely attached to a golf club head, does not move during a golf swing and has a weight that may be easily modified.

SUMMARY OF THE INVENTION

The present invention provides a swing weight apparatus which is securable to a golf club head for swinging practice. The swing weight apparatus includes a swing weight body and at least one insertable weight. A swing weight body includes a bottom layer, a middle layer, and a top layer. Each layer preferably has a perimeter which has a substantially semi-circular or substantially curved portion; and a substantially straight portion. The substantially curved portion of each layer is attached to each other. Preferably, the bottom layer and the top layer are releasably joined to each other on the substantially straight portion with a removable fastener such as a zipper, or a hook and loop fastener commonly referred to as VELCRO (TM). Each insertable weight preferably includes a quantity of weighted material which is retained between two outside layers. The perimeter of each insertable weight is shaped to fit within the middle and top layers. The perimeters of the two outside layers are attached to each other with the weighted material therein. A hosel strip preferably is attached to the substantially straight portion of the top and bottom layers at one end thereof. The hosel strip has a releasable fastener which allows thereof to be attached to itself.

The swing weight apparatus is preferably attached to a golf club head in the following manner. The top and middle layers are separated from each other and at least one insertable weight is inserted therebetween. The bottom layer is then separated from the middle layer and the golf club head is inserted therebetween. The releasable fastener is closed over the golf club head. If the hosel strap is included with the swing weight apparatus; the hosel strap is wrapped around the hosel and itself.

Accordingly, it is an object of the present invention to provide a swing weight apparatus which may be securely attached to a golf club head.

It is a further object of the present invention to provide a swing weight apparatus which does not move during a golf swing.

Finally, it is another object of the present invention to provide a swing weight apparatus which may easily have its weight increased or decreased.

These and additional objects, advantages, features and benefits of the present invention will become apparent from the following specification.

DETAILED DESCRIPTION OF THE PREFERRED EMBODIMENTS

Figure 1:
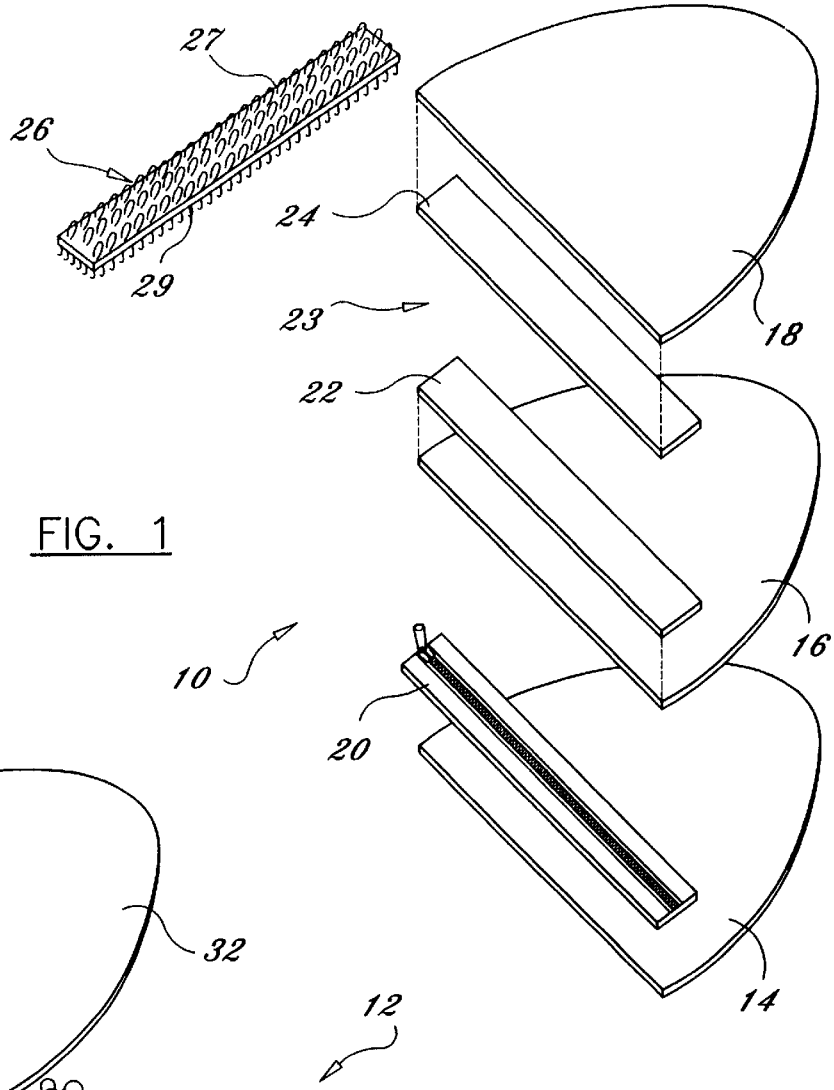
FIG. 1 is an exploded perspective view of a swing weight body of a swing weight apparatus in accordance with the present invention.
Figure 2:
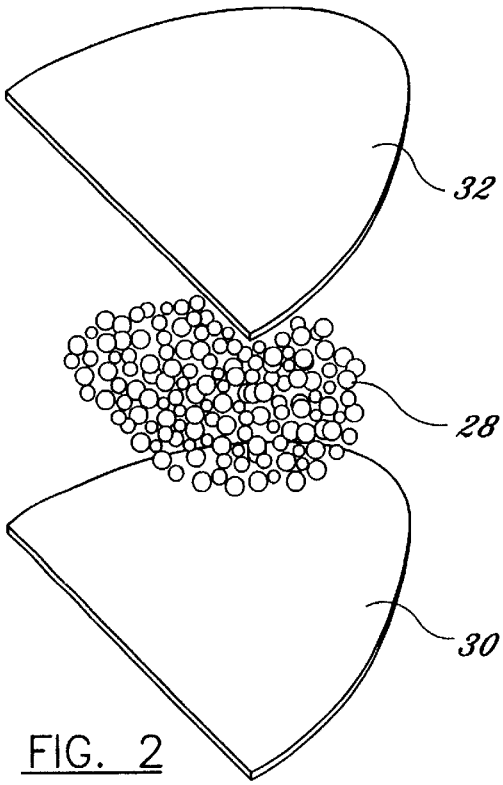
FIG. 2 is an exploded perspective view of an insertable weight of a swing weight apparatus in accordance with the present invention.
Figure 3:
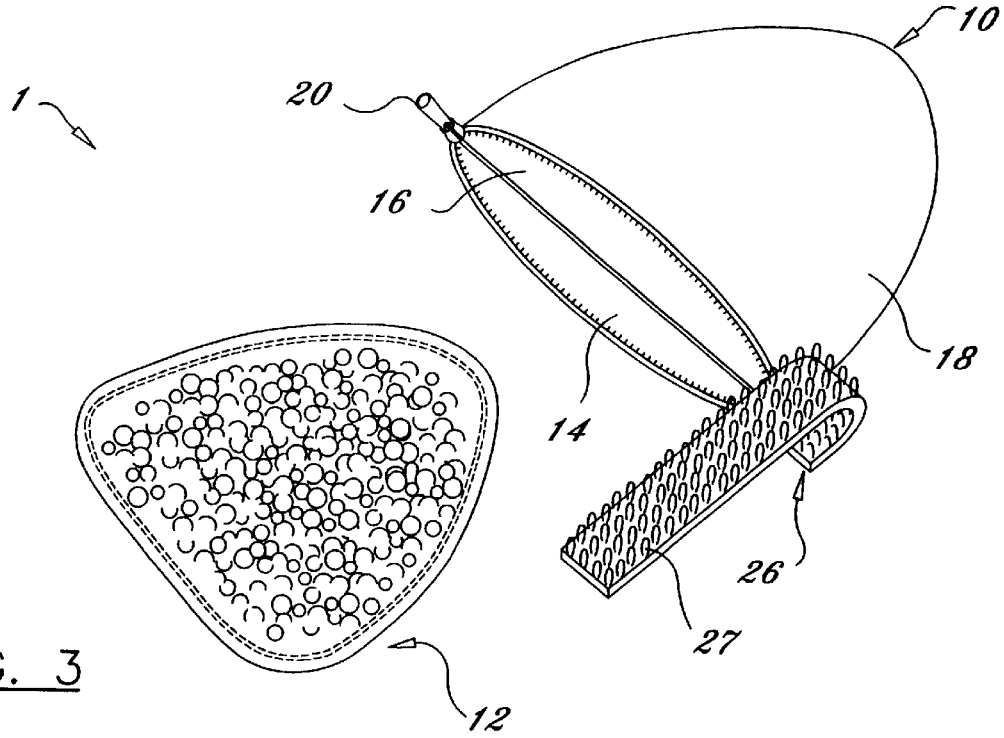
FIG. 3 is a partially exploded view of a swing weight apparatus in accordance with the present invention.
Figure 4:
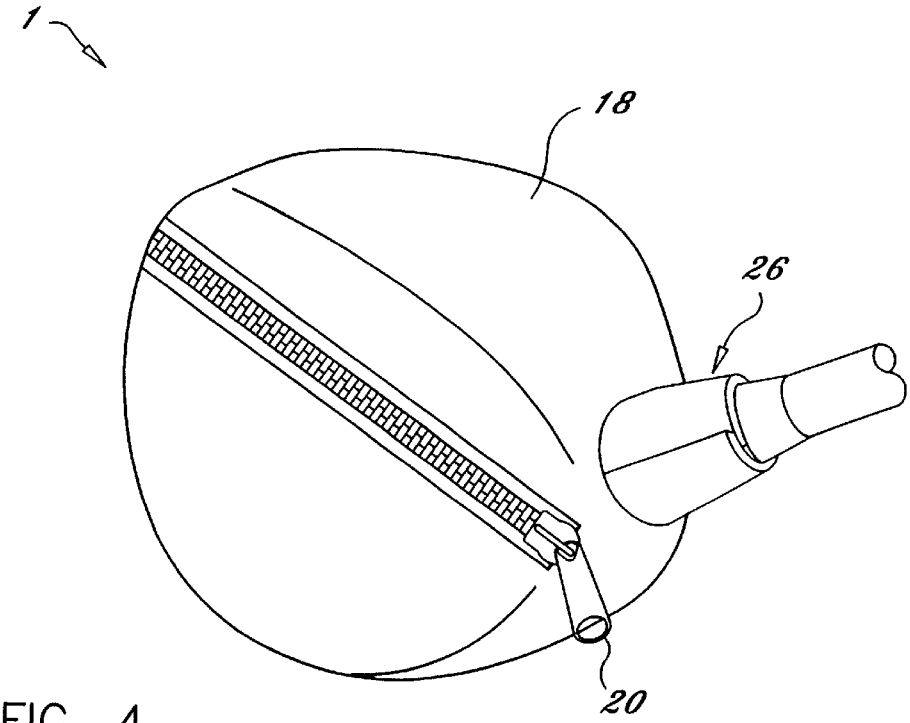
FIG. 4 is a perspective view of a swing weight apparatus attached to a golf club head in accordance with the present invention.
Figure 5:
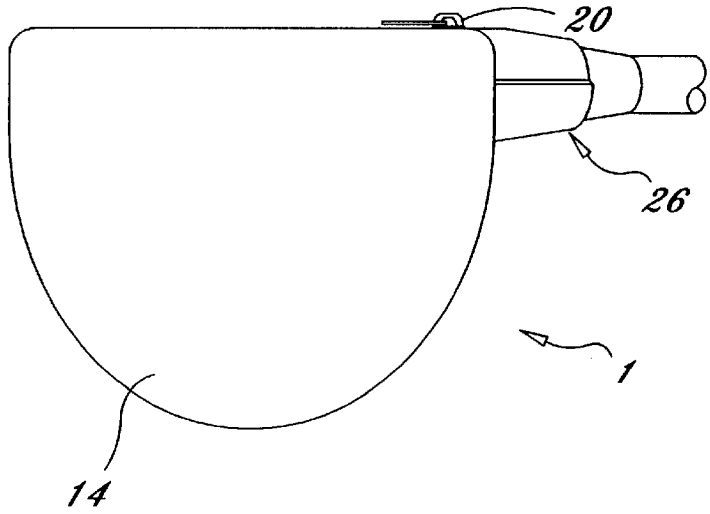
FIG. 5 is a bottom view of a swing weight apparatus attached to a golf club head in accordance with the present invention.
Figure 6:
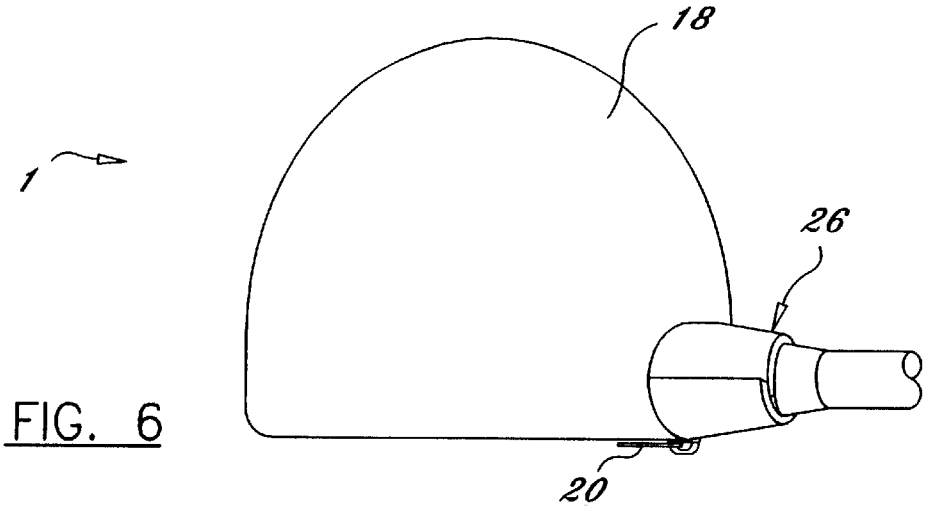
FIG. 6 is a top view of a swing weight apparatus attached to a golf club head in accordance with the present invention.
Figure 7:
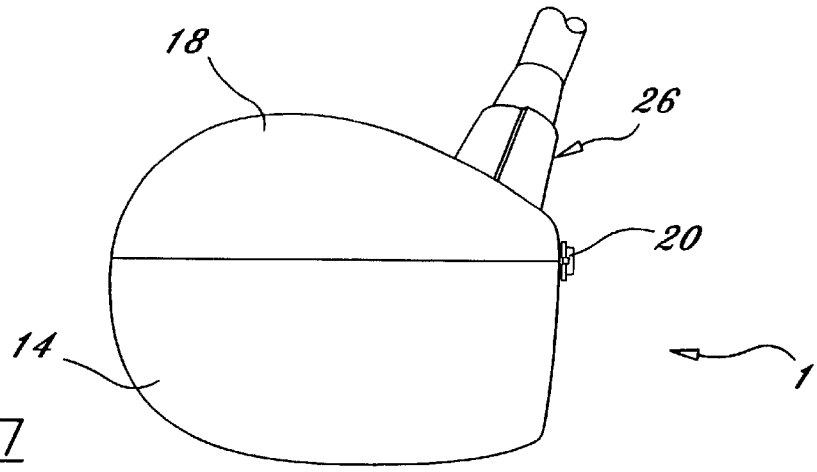
FIG. 7 is a side view of a swing weight apparatus attached to a golf club head in accordance with the present invention.

With reference now to the drawings, and particularly to FIG. 3, there is shown a partially exploded perspective view of a swing weight apparatus 1. With reference to FIGS. 1 and 2, the swing weight apparatus 1 includes a swing weight body 10 and at least one insertable weight 12. A swing weight body 10 includes a bottom layer 14, a middle layer 16, and a top layer 18. Each layer preferably has a perimeter which has a substantially curved portion and a substantially straight portion. The substantially curved portion of each layer are attached to each other by sewing, heat sealing, or any other suitable assembly process. The substantially semi-circular portion of each layer perimeter may be other shapes to accommodate the shape of a particular golf club head.

With reference to FIG. 3, a first compartment is formed between the bottom and middle layers and a second compartment is formed between the top and middle layers. The bottom layer 14 and the top layer 18 are releasably joined to each other on the substantially straight portion with a removable fastener 20 such as a zipper as shown in FIG. 1 or a hook and loop fastener. One side of the releasable fastener 20 is attached to the bottom layer 14 with any suitable assembly process and the other side is attached to the top layer 18 with any suitable assembly process.

The top and middle layers are preferably fabricated from thick durable material which will not easily wear out from multiple insertions of the at least one insertable weight 12. The top and middle layers are preferably fabricated from a "duck" material, but other materials may also be used. The bottom layer 14 is preferably fabricated from a stretchable material to allow a golf club head to be snugly retained by the swing weight body 10. The bottom layer is preferably fabricated from a stretchable material such as a spandex lycra blend, other materials may also be used.

Preferably, the middle and top layers are releasably attached to each other with a releasable fastener 23.

Preferably, the releasable fastener 23 is a hook and loop fastener, but could be a zipper or any other suitable releasable fastener. The hook fastener 22 could be attached to the middle layer 16 and the loop fastener 24 could be attached to the top layer 18. The loop fastener 24 could also be attached to the middle layer 16 and the hook fastener 22 attached to the top layer 18. Preferably, a hosel strap 26 is attached to the top layer 18 and bottom layer 14 at an end of the substantially straight portion of each layer. The hosel strap 26 preferably has a hook fastener portion 27 formed on a top of the hosel strap 26 and a loop fastener portion 29 formed on a bottom thereof. The hoop fastener portion 27 may also be placed on a bottom of the hosel strap 26 and the loop fastener portion 29 on a top of the hosel strap 26.

Each insertable weight 12 preferably includes a quantity of weighted material 28 such as buck shot which is retained between a first outside layer 30 and a second outside layer 32. The perimeter of each insertable weight is shaped to fit within the middle and top layers. The perimeters of the first and second outside layers are attached to each other by sewing, heat sealing or other suitable assembly process.

The swing weight apparatus 1 is preferably attached to a golf club head in the following manner. With reference to FIGS. 4–7, the top layer 18 and the middle layer 16 are separated from each other and the at least one insertable weight 12 is inserted therebetween. If the hook and loop fasteners 22 and 24 are included; the top and middle layers are pressed against each other adjacent the substantial straight portion of each layer to fasten the hook fastener 22 against loop fastener 24 and securely retain the at least one insertable weight 12. The bottom layer 14 is then separated from the middle layer 16 and the golf club head is inserted therebetween. The releasable fastener 20 is closed over the golf club head. If the hosel strap 26 is included with the swing weight apparatus; the hosel strap 26 is wrapped around itself such that the hook fastener portion 27 contacts the loop fastener portion 29.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A swing weight apparatus for attachment to a golf club head comprising:

a swing weight body having two compartments;

said swing weight body including a bottom layer, a middle layer, and a top layer, each said layer having a substantially curved portion and a substantially straight portion, said substantially curved portion of each said layer being attached to each other;

a hosel strap being attached to said top and bottom layers at an end of said substantially straight portion of each layer, one of a hook fastener portion and a loop fastener portion being formed on a top of said hosel strap, one of said loop fastener portion and said hook fastener portion being formed on a bottom of said hosel strap; and at least one insertable weight capable of being inserted into one of said compartments, wherein a golf club head is capable of being inserted into the other said compartment.

2. The swing weight apparatus for attachment to a golf club head of claim 1, further comprising:

a removable fastener, one side of said removable fastener being attached to said substantially straight portion of said top layer and the other side of said removable fastener being attached to said substantially straight portion of said bottom layer.

3. The swing weight apparatus for attachment to a golf club head of claim 1, further comprising:

one of a hook fastener and loop fastener being attached to said top layer and one of said loop fastener and said hook fastener being attached to said middle layer.

4. The swing weight apparatus for attachment to a golf club head of claim 1, further comprising:

said insertable weight including a weighted material, a first outside layer and a second outside layer, said weighted material being inserted between said outside layers, a perimeter of said outside layers being attached to each other.

5. A swing weight apparatus for attachment to a golf club head comprising:

a swing weight body having a bottom layer, a middle layer, and a top layer, each said layer having a perimeter with a substantially straight portion, said perimeter of each said layer other than said substantially straight portion being attached to each other, one compartment being formed between said bottom and middle layers and another compartment being formed between said middle and top layers; and at least one insertable weight capable of being inserted into one of said compartments, wherein a golf club head is capable of being inserted into the other said compartment.

6. The swing weight apparatus for attachment to a golf club head of claim 5, further comprising:

a removable fastener, one side of said removable fastener being attached to said substantially straight portion of said top layer and the other side of said removable fastener being attached to said substantially straight portion of said bottom layer.

7. The swing weight apparatus for attachment to a golf club head of claim 5, further comprising:

said perimeter of each said layer other than said substantially straight portion having a shape which is substantially curved.

8. The swing weight apparatus for attachment to a golf club head of claim 5, further comprising:

one of a hook fastener and loop fastener being attached to said top layer and one of said loop fastener and said hook fastener being attached to a middle layer.

9. The swing weight apparatus for attachment to a golf club head of claim 5, further comprising:

a hosel strap being attached to said top and bottom layers at an end of said substantially straight portion of each layer, one of a hook fastener portion and a loop fastener portion being formed on a top of said hosel strap, one of said loop fastener portion and said hook fastener portion being formed on a bottom of hosel strap.

10. The swing weight apparatus for attachment to a golf club head of claim 5, further comprising:

said insertable weight including a weighted material, a first outside layer and a second outside layer, said weighted material being inserted between said outside layers, a perimeter of said outside layers being attached to each other.

11. A swing weight apparatus for attachment to a golf club head comprising:

a swing weight body having a bottom layer, a middle layer, and a top layer, each said layer having a perimeter with a substantially straight portion, said perimeter of each said layer other than said substantially straight portion being attached to each other, one compartment being formed between said bottom and middle layers and another compartment being formed between said middle and top layers;

a removable fastener, one side of said removable fastener being attached to said substantially straight portion of said top layer and the other side of said removable fastener being attached to said substantially straight portion of said bottom layer; and at least one insertable weight capable of being inserted into one of said compartments, wherein a golf club head is capable of being inserted into the other said compartment.

12. The swing weight apparatus for attachment to a golf club head of claim 11, further comprising:

said perimeter of each said layer other than said substantially straight portion having a shape which is substantially curved.

13. The swing weight apparatus for attachment to a golf club head of claim 11, further comprising:

one of a hook fastener and loop fastener being attached to said top layer and one of said loop fastener and said hook fastener being attached to a middle layer.

14. The swing weight apparatus for attachment to a golf club head of claim 11, further comprising:

a hosel strap being attached to said top and bottom layers at an end of said substantially straight portion of each layer, one of a hook fastener portion and a loop fastener portion being formed on a top of said hosel strap, one of said loop fastener portion and said hook fastener portion being formed on a bottom of hosel strap.

15. The swing weight apparatus for attachment to a golf club head of claim 11, further comprising:

said insertable weight including a weighted material, a first outside layer and a second outside layer, said weighted material being inserted between said outside layers, a perimeter of said outside layers being attached to each other.

16. The swing weight apparatus for attachment to a golf club head of claim 11, further comprising:

said top and middle layers being fabricated from a thick durable material.

17. The swing weight apparatus for attachment to a golf club head of claim 11, further comprising:

said bottom layer being fabricated from a stretchable material.

* * * * *